United States Patent [19]

Bell

[11] 4,029,047

[45] June 14, 1977

[54] TONER HANDLING SYSTEM

[75] Inventor: George E. Bell, Ontario, N.Y.

[73] Assignee: Xerox Corporation, Stamford, Conn.

[22] Filed: Oct. 28, 1975

[21] Appl. No.: 626,588

[52] U.S. Cl. ..... 118/652

[51] Int. Cl.[2] ..... G03G 15/08

[58] Field of Search ..... 118/637; 222/189; 210/172; 355/15

[56] References Cited

UNITED STATES PATENTS

| | | | |
|---|---|---|---|
| 171,746 | 3/1876 | Tally | 222/189 X |
| 541,216 | 6/1895 | Shanley | 222/189 X |
| 720,918 | 2/1903 | Hesketh | 222/189 X |
| 780,938 | 1/1905 | Clarke | 222/189 |
| 813,402 | 2/1906 | Chase | 222/189 |
| 1,641,051 | 8/1927 | Rheney | 222/189 |
| 3,217,887 | 11/1965 | Meister | 222/189 |
| 3,793,986 | 2/1974 | Latone | 118/637 |

*Primary Examiner*—Henry S. Jaudon
*Attorney, Agent, or Firm*—Earl T. Reichert

[57] ABSTRACT

A toner handling system having developing apparatus for developing a latent electrostatic image on a photoreceptor and a reclaiming system for reclaiming residual toner removed from the photoreceptor, has a novel reclaiming receptacle. The receptacle includes two openings, an unfiltered opening through which toner enters the receptacle during the reclaiming operation, and a filtered opening which is closed during this operation. When a predetermined amount of toner has been deposited in the receptacle, the latter is disconnected from the remainder of the reclaiming system, the unfiltered opening closed, and the filtered opening opened. The reclaimed toner is then poured through the filtered opening back into the developing apparatus, and the receptacles with any contaminant therein is discarded.

4 Claims, 3 Drawing Figures

TONER HANDLING SYSTEM

BACKGROUND OF THE INVENTION

The present invention relates to an improved toner handling system for an electrostatic reproduction machine. More particularly, the invention is directed to improved apparatus for reclaiming residual toner from a photosensitive surface, and for loading the reclaimed toner into a developing apparatus.

In conventional xerography, a xerographic plate comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas where light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. The developed image is then transferred to a suitable transfer member (e.g., paper), and the image is affixed thereto to form a permanent record of the original document. Residual toner is then removed from the photosensitive surface prior to charging the surface again.

Conventionally, the residual toner removed from the photosensitive surface is reclaimed in a receptacle and reused. Typically, the receptacle is connected to a filler hose on the developing apparatus, and dumped through the hose and a filter within the hose into the developing apparatus; the receptacle is then discarded. The problem with this arrangement is that the filter in the filler hose of the developing apparatus becomes clogged after pouring several batches of toner through the hose. Because the filter is located several inches into the hose, removing the contaminant from the filter and hose is a difficult job, in addition to being a dirty one.

SUMMARY OF THE INVENTION

The present invention is directed to a toner handling system which includes a developing apparatus for depositing toner on a photoreceptor to develop a latent electrostatic image, and a reclaiming system for reclaiming residual toner cleaned from the photoreceptor after the developed image has been transferred to a suitable transfer member such as a sheet of paper. The reclaimed toner is collected in a receptacle through an unfiltered opening in the receptacle. After a predetermined amount of toner has been collected in the receptacle, the receptacle is removed from place, the unfiltered opening is closed, and a filtered opening in the receptacle is opened. The reclaimed toner is then poured through the filtered opening into a filler hose connected to the developing apparatus. Preferably, the receptacle is then discarded as is done with a prior art receptacle. Thus, the problem discussed in the preceding paragraph is solved.

DESCRIPTION OF THE INVENTION

DESCRIPTION OF THE INVENTION

Figure 1:
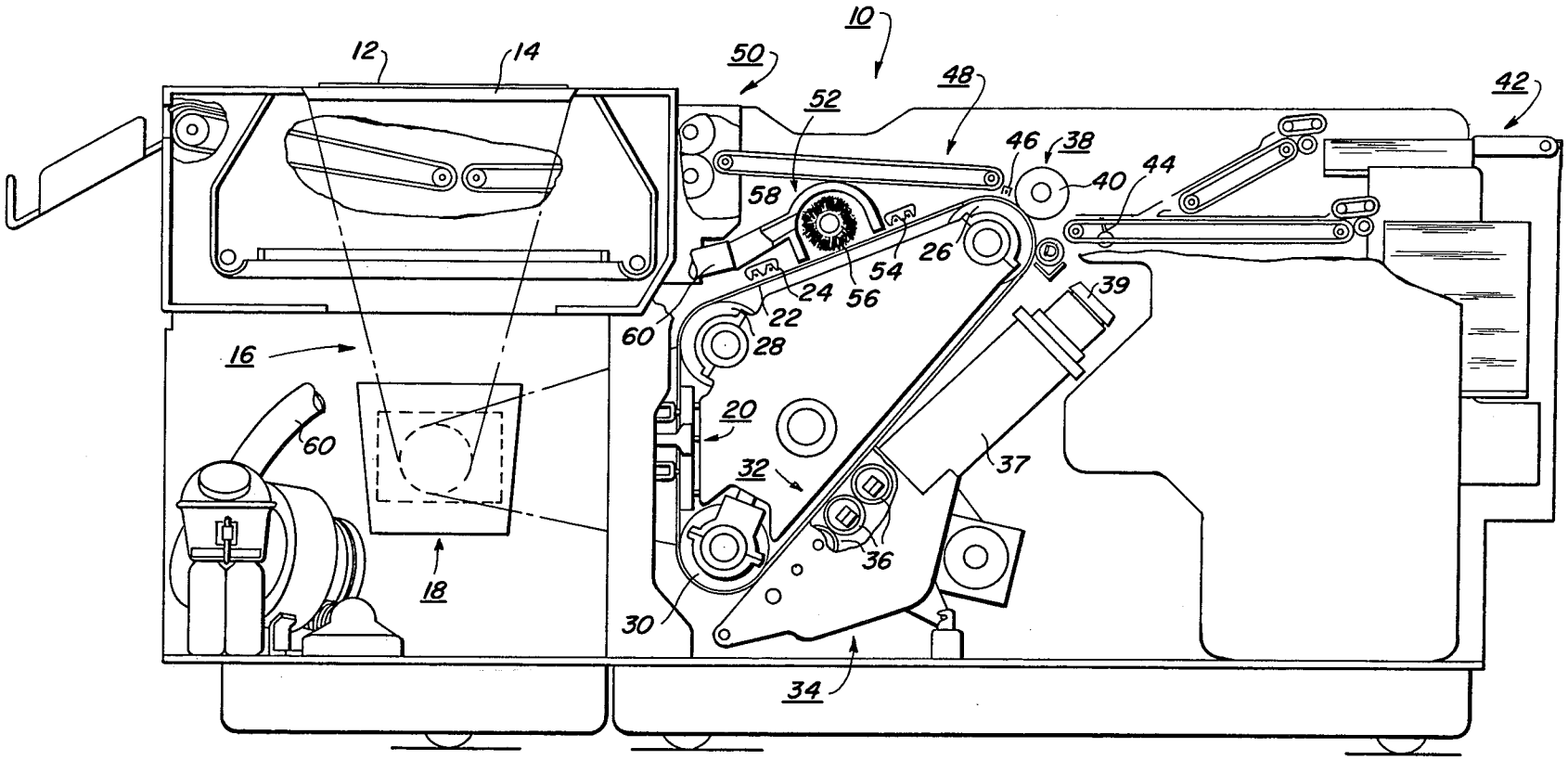
FIG. 1 is a schematic sectional view of an electrostatic reproduction machine embodying the principles of the present invention.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with an oppositely charged developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support platen 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes around the roller 30 and through a developing station 32 where a developing apparatus indicated generally by the reference numeral 34 is positioned. The developing apparatus 34 comprises a plurality of magnetic brushes 36 which carry developing material to the surface of the upwardly moving belt 22, and a toner dispenser 37 covered by a cap 39. As the developing material is applied to the belt, toner particles in he development material are electrostatically attracted to be charged photosensitive surface to form a powder image (an electrostatic developed image).

The developed electrostatic image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith.

A suitable sheet transport mechanism transports sheets of paper seriatim from a paper handling mechanism indicated generally by the reference numeral 42 to the developed image on the belt as the same is carried around the roller 26. In passing from the paper handling mechanism to the transfer roll 40, each sheet contacts a plurality of registration fingers 44 which serve to actuate various components within the machine at the proper time during passage of each sheet through the machine.

As a sheet emerges from the transfer station 38, a charge is deposited thereon by a detack corona generating device 46 to lessen the electrostatic attraction between the belt 22 and the sheet so that the latter can be removed by a vacuum stripping and transport mechanism 48. The sheet is thereafter retained on the underside of the vacuum stripping transport mechanism 48 for movement into a fuser assembly indicated generally by the reference numeral 50 wherein the powder image on the sheet is permanently affixed thereto. After fusing, the finished copy is discharged at a suitable point for collection. The toner particles remaining as residue on the belt 22 are carried by the belt to a cleaning apparatus 52. The cleaning apparatus 52 comprises a corona discharge device 54 for neutralizing charges remaining on the untransferred toner particles, a rotating brush 56 mounted within a housing 58, and a vacuum outlet 60.

Figure 2:
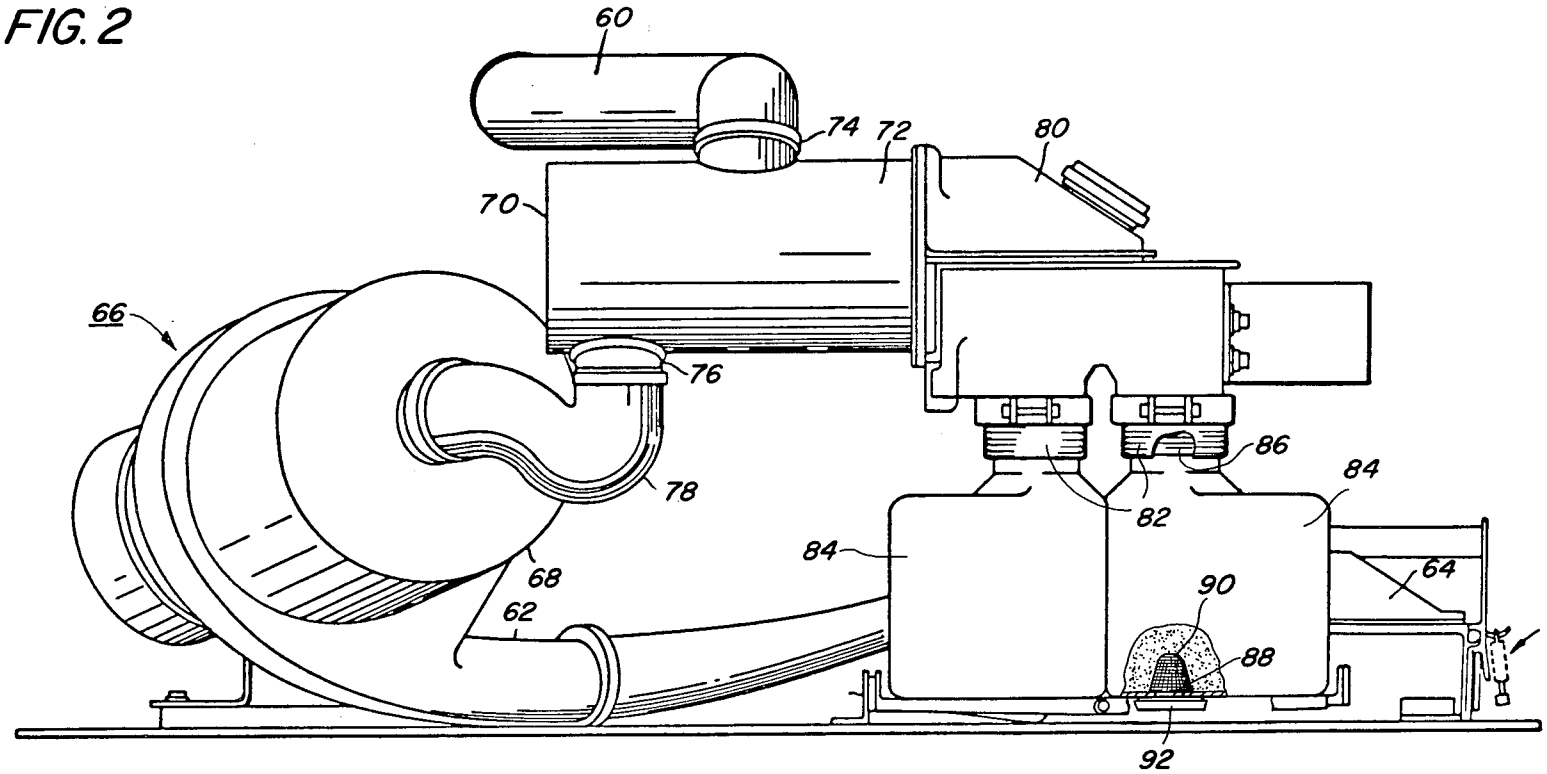
FIG. 2 is a schematic view of the toner reclaiming system.
Figure 3:
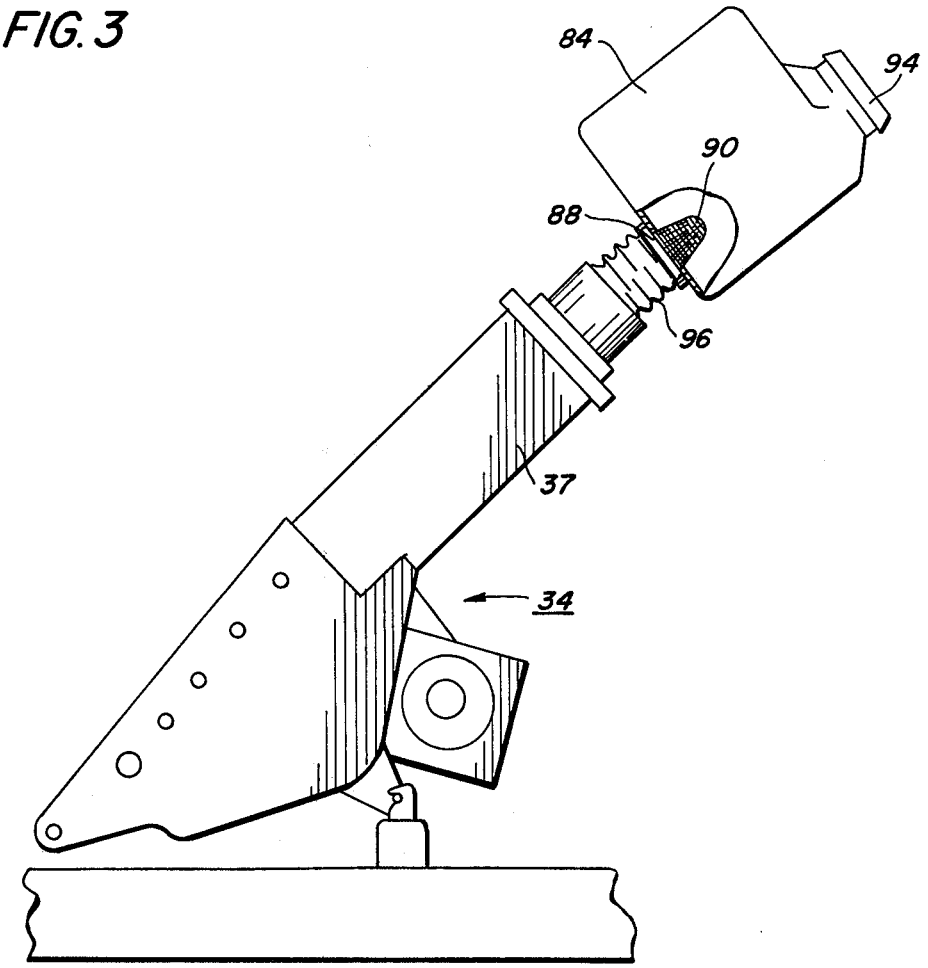
FIG. 3 shows reclaimed toner be poured from the reclaiming receptacle into the filter hose of the developer.

Referring to FIGS. 2 and 3, the present invention will be described in detail. The toner reclaiming system is in the form of an air conveying system including the duct 60 connected to the housing 58, an output duct 62 having a filtering element 64 as the output end for the system, pumping apparatus such as a motor-driven blower or fan 66 interposed between the ducts 60 and 62. The blower 66 may be of the conventional type having an impeller mounted for rotation within a blower housing 68, the blower having its input end connected to the duct 60 and its output end connected to the duct 62. The operation of the blower 66 is such as to move air from the brush housing 58, through the duct 60, through a separating means 70, through the blower housing 68, through the duct 62, and finally through the final filtering element 64 and out into the surrounding atmosphere.

Positioned in the duct 60 between its input end and the blower means 66, and operating as part of the air conveying system, is separating means 70 which is used to separate the toner particles from the air flowing through the system. The separating means 70 includes a housing 72 formed with an input fitting 74 to which the duct 60 is connected and an output fitting 76 by which a short duct 78 connects the housing 72 to the input side of the blower housing 68. The separating means 70 may be of any type which is adapted to separate particles from air flow and to permit the continued flow of the "clean" air while moving the particles to a collecting point. It is preferred that the separator be of the centrifugal type which is constructed so that particle-laden air is set in a whirling motion to drive the particles against walls by centrifugal forces.

The toner-free air flows through the housing 72 between walls within the housing, out of the housing via fitting 76, and through the duct 78 into the blower housing 68. The entire movement of air is produced by the blower 66, and after being directed therethrough completes its path through the duct 62 and to the filtering element 64, the latter being used to precipitate any toner particles which may remain in air after leaving the separating means 70.

The separated toner particles are directed out of housing 72 and into a manifold 80. Bellows 82, capable of expandable and compressible deformation, support a plurality of receptacles 84 beneath the manifold 80. The receptacles 84, which may be made of plastic or the like, receive the separated residual toner particles. Generally, the depositing of toner particles in the receptacles is fairly even; the containers receive particles in substantially equal amounts. U.S. Pat. Nos. 3,793,986 describes the toner reclaiming system in greater detail, and U.S. Pat. No. 3,838,922 describes the apparatus for terminating the operation of the machine 10 when a predetermined amount of toner has been deposited in the receptacles 84. To the extent necessary, the disclosures of these patents is incorporated by reference.

As can be seen in FIGS. 2 and 3, each of the receptacles includes an unfiltered opening 86 to which each of the bellows 82 is connected by any suitable means, the reclaimed toner entering each receptacle through the opening 86. The bottom of each receptacle includes an opening 88 covered by a generally conically shaped filter 94, this opening being closed by a cap 92 during the reclaiming operation. The cap may be connected to the opening 88 by any suitable means such as threads.

When a predetermined amount of toner has been collected in each of the receptacles 84 and the operation of the machine 10 is terminated, each receptacle is disconnected from its corresponding bellows 82, and the opening 86 is closed with a suitable cap 94 (FIG. 3). Cap 39 of the developing apparatus is removed, the receptacle 84 inverted, and the filtered opening 88 is opened and connected by any suitable means such as threads, clamps, etc. to a bellows or other flexible and collapsible filter hose 96 pulled from the toner dispenser 37 (FIG. 3). The reclaimed toner is then poured through the hose 96 into the toner dispenser 37 of the developing apparatus 34, after which the receptacle with the contaminant therein is disconnected from the hose 96 and discarded. This arrangement negates the cumulative effect of pouring several batches of reclaimed toner through a filler hose having a filter therein, and eliminates the problem of removing debris from a filter located several inches within the filler hose as was necessary with the prior art arrangement.

What is claimed is:

1. An improved toner handling system having means for developing a latent electrostatic image on a photoreceptor, and means for removing and reclaiming residual toner from the photoreceptor, the reclaiming means including a brush in contact with the photoreceptor and a receptacle into which the residual toner is deposited, wherein the improvement comprises:

means forming a first unfiltered opening in the receptacle, means for conveying toner from the brush to the first unfiltered opening, means forming a second filtered opening in the receptacle, and means for closing the second filtered opening while residual toner is being deposited in the receptacle.

2. An improved toner handling system as set forth in claim 1, and further including means for closing the first unfiltered opening after the receptacle has been disconnected from the remainder of the reclaiming system.

3. An improved toner handling system as set forth in claim 2, wherein the openings are formed in opposite ends of the receptacle.

4. An improved toner handling system as set forth in claim 3, wherein the means forming the second filtered opening includes a generally conically shaped filter.

* * * * *